United States Patent [19]

Scheurecker

[11] 4,358,007

[45] Nov. 9, 1982

[54] SUPPORTING AND GUIDING STAND ARRANGEMENT TO BE USED IN A BOW-TYPE CONTINUOUS CASTING PLANT

[75] Inventor: Werner Scheurecker, Linz, Austria

[73] Assignee: Voest-Alpine Aktiengesellschaft, Linz, Austria

[21] Appl. No.: 124,422

[22] Filed: Feb. 25, 1980

[30] Foreign Application Priority Data

Mar. 7, 1979 [AT] Austria ..... 1726/79

[51] Int. Cl.[3] ..... B22D 11/14

[52] U.S. Cl. ..... 193/35 R; 164/442

[58] Field of Search ..... 193/35 R, 37; 164/448, 164/82, 282; 72/240, 248; 226/89, 90, 189

[56] References Cited

U.S. PATENT DOCUMENTS

| | | | |
|---|---|---|---|
| 3,794,107 | 2/1974 | Bollig et al. | 164/282 |
| 3,920,065 | 11/1975 | Hall et al. | 164/282 |
| 3,994,334 | 11/1976 | Schrewe | 164/282 |
| 4,074,746 | 2/1978 | Scheurecker et al. | 193/35 R |
| 4,076,069 | 2/1978 | Scheinecker et al. | 193/35 R |

FOREIGN PATENT DOCUMENTS

| | | | |
|---|---|---|---|
| 1957690 | 5/1971 | Fed. Rep. of Germany | 193/37 |
| 1920757 | 10/1973 | Fed. Rep. of Germany | 164/282 |
| 2304426 | 3/1976 | France | 164/282 |

*Primary Examiner*—Robert B. Reeves
*Assistant Examiner*—Gene A. Church
*Attorney, Agent, or Firm*—Brumbaugh, Graves, Donohue & Raymond

[57] ABSTRACT

A supporting and guiding stand for a bow-type continuous casting plant comprises supporting segments in which the rollers of the oppositely arranged inner and outer guideways are arranged at a distance from one another. The supporting segments are removable from the arc outer side and are exchangeable. The individual supporting segments are displaceable on rails to accommodating positions, which are provided on the outer side of the arc at different heights, and are preferably offset from each other in step-like manner.

4 Claims, 4 Drawing Figures

SUPPORTING AND GUIDING STAND ARRANGEMENT TO BE USED IN A BOW-TYPE CONTINUOUS CASTING PLANT

BACKGROUND OF THE INVENTION

The invention relates to a supporting and guiding stand for a bow-type continuous casting plant comprising supporting segments in which the rollers of the oppositely arranged inner and outer guideways are mounted at a distance from one another, the supporting segments being removable from the arc outer side, and exchangeable.

Arrangements of this kind have already been known and are described for instance in German Auslegeschrift No. 1,920,757. The guiding segments, which are exchangeable from the arc outer side, have the advantage that the individual rollers can be arranged form one another at a smaller axial distance, which is important with broad slabs. With segments that are removable from the arc inner side, greater axial distances of the rollers are necessary in order to prevent a jamming of the supporting segments during the removal.

With the supporting and guiding stand mentioned above, a rail guide for a removing device and a carrying device, respectively, is provided parallel to the strand guideway at a distance towards the lower side of the supporting roller stand. This removing device is made up of a frame that is displaceable by wheels on the rail guide and a hydraulic cylinder for pulling out the segments from the installed position. The supporting segment removed is then moved downwards along the rail guide, whose last part is tiltable into the horizontal. From there, the supporting segment together with the removing or carrying device is brought into an accommodating position provided on the horizontal end run and taken up by a crane. The installation is effected in the reverse order.

The known construction apparently is very cumbersome, since it calls for a movable removing and carrying device of its own, by which the supporting segment has to be transported as far as into the accommodating position. Further difficulties are caused by the fact that a plurality of moved or driven devices have to be provided at the outer side of the arc, which devices are subject to problems caused by cinders and dirt.

SUMMARY OF THE INVENTION

The invention aims at avoiding these disadvantages and difficulties and has as its object to make possible the removal and exchange of supporting segments from the arc outer side with simple construction means without having to provide a special carrying device for the supporting segments.

This object is achieved with a supporting and guiding stand of the initially-defined kind in that the individual supporting segments are displaceable on rails to accommodating positions provided on the outer side of the arc at different heights, preferably set off towards one another in a step-wise manner.

Advantageously, the rails are designed in two parts, a front part, which faces the arc, and extends radially, and a rear part extending horizontally.

Suitably, the supporting segments are held in position relative to the plant carrying structure in the installed position ready for casting by, consoles.

BRIEF DESCRIPTION OF THE DRAWINGS

The invention is explained in more detail by way of one embodiment and with reference to the accompanying drawings, wherein.

DESCRIPTION OF AN ILLUSTRATIVE EMBODIMENT

Figure 1:
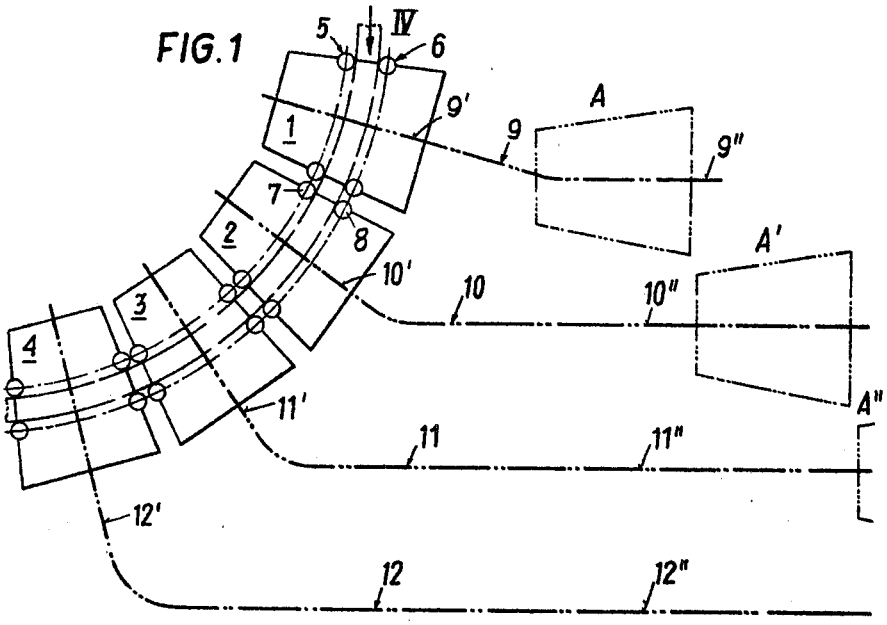
FIG. 1 is a schematic illustration of the plant in side view.

In FIG. 1 supporting segments 1, 2, 3 and 4 are subsequently arranged in the region of the circular arc of the arcuate strand guide, each supporting segment comprising opposite roller ways 5, 6 formed by spaced-apart rollers 7, 8. The individual segments are detachable from their installed position and removable along rails 9 and 10, and 11 and 12, respectively on the arc outer side. The rails comprise a radial part 9', 10', 11', 12' adjacent the outer side of the guideway and a horizontal part 9'',10'', 11'' and 12'' following thereupon. These horizontal rail parts lie at different heights, and advantageously also end at positions offset from one another in the horizontal direction in a step-like manner, so that accommodating and lifting positions, which are denoted by A, A' and A'', can be operated reached by a crane without impediment.

Figure 2:
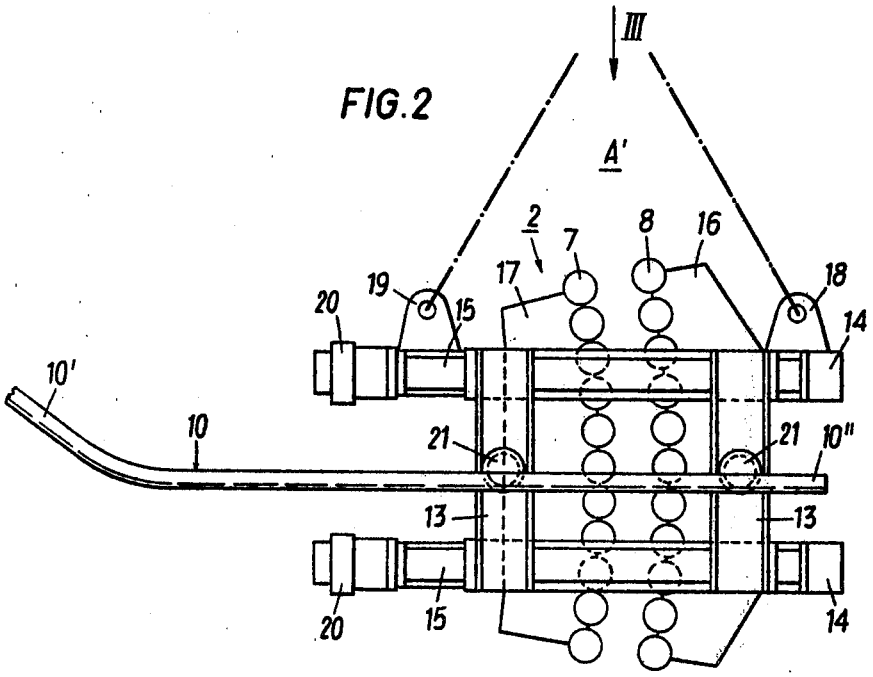
FIG. 2 is an illustration of a supporting segment in the moved-out position, i.e. in the accommodating or lifting position.
Figure 3:
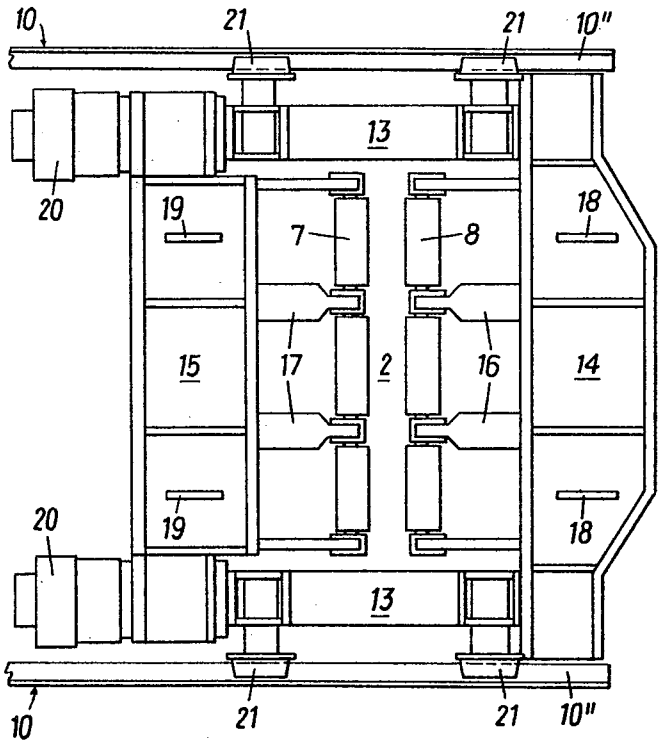
FIG. 3 is a top view onto the supporting segment in the direction of the arrow III of FIG. 2.

In FIGS. 2 and 3 the segment 2 is illustrated in the removed state in position A'. The supporting segment basically comprises a frame 13, an outer cross beam 14, an inner cross beam 15, and roller carriers 16 and 17 that include the rollers 7 and 8. On the beams 14 and 15, suspension brackets 18 and 19 are arranged. Adjustment means for the roller distance are denoted by 20. On the frame 13, running wheels 21 are fastened on both sides of the segment, which wheels are guided on rails 10 that have an angular cross section.

Figure 4:
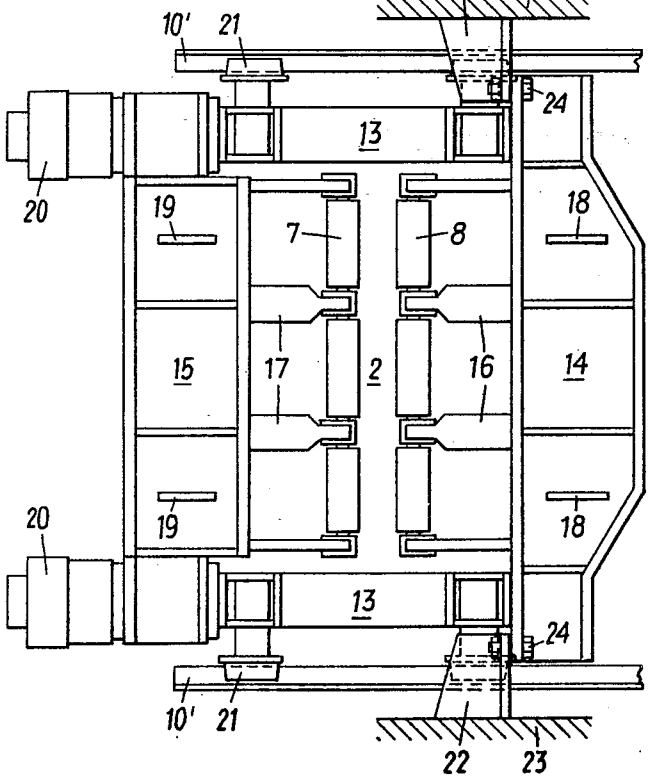
FIG. 4 is a view in the direction of the arrow IV of FIG. 1.

In FIG. 4 the segment 2 is shown in the installed position, i.e. ready for casting, wherein it is fixed on the plant carrying structure 23 via consoles 22.

For removing the supporting segment from the guiding arc and for installing the supporting segment into the guiding arc, respectively, no separate displacesable carrying device is needed, as can be seen. After loosening of the screws 24 or other suitable connecting means by which the consoles are connected with the sypporting segment, the supporting segment can be moved out along the radially slanted rail piece 10', no separate drive being necessary therefor. A rope winch (not illustrated herein) arranged in the center of the circular arc and with which the supporting segment is braked when moved out and pulled when moved in, suffices for this purpose. For transportation in the horizontal part 10, the most simple and common pull devices will suffice.

What I claim is:

1. In a supporting and guiding stand arrangement to be used in a bow-type continuous casting plant and of the type including an inner guideway and an outer guideway arranged opposite each other, rollers arranged on said inner guideway and said outer guideway at a distance from one another, and supporting segments for accommodating said rollers, said supporting segments being removable from the arc outer guideway side and being exchangeable, the improvement comprising accommodating positions provided on the outer guideway side of the arc at different heights, and rails for directly supporting and displacing said supporting segments to said accommodating positions without an additional carrying device for supporting the segments during displacement.

2. A supporting and guiding stand arrangement as set forth in claim 1, wherein said accommodating positions are arranged to be offset in step-wise manner relative to each other.

3. A supporting and guiding stand arrangement as set forth in claim 1, wherein said rails are designed in two parts so as to include a front part facing the arc and extending radially therefrom and a rear part extending horizontally from the radial part.

4. A supporting and guiding stand arrangement as set forth in claim 1, further comprising a plant carrying structure and consoles for holding said supporting segments, when installed and ready for casting, in position relative to said plant carrying structure.

* * * * *